US011753122B2

(12) United States Patent
Steiner et al.

(10) Patent No.: US 11,753,122 B2
(45) Date of Patent: Sep. 12, 2023

(54) METHOD AND APPARATUS FOR INSTALLING A BOAT FENDER

(71) Applicant: Gregory Steiner, Cape Coral, FL (US)

(72) Inventors: Gregory Steiner, Cape Coral, FL (US); Michael Anthony Carufe, III, Naples, FL (US)

( * ) Notice: Subject to any disclaimer, the term of this patent is extended or adjusted under 35 U.S.C. 154(b) by 121 days.

(21) Appl. No.: 17/505,855

(22) Filed: Oct. 20, 2021

(65) Prior Publication Data

US 2022/0119080 A1 Apr. 21, 2022

Related U.S. Application Data

(60) Provisional application No. 63/094,669, filed on Oct. 21, 2020.

(51) Int. Cl.
*B63B 59/02* (2006.01)

(52) U.S. Cl.
CPC ..... *B63B 59/02* (2013.01)

(58) Field of Classification Search
CPC ..... B63B 59/00; B63B 59/02
USPC ..... 114/219
See application file for complete search history.

(56) References Cited

U.S. PATENT DOCUMENTS 7,930,807 B2 * 4/2011 Gotovac ..... F16G 11/048 24/136 R

* cited by examiner

*Primary Examiner* — Lars A Olson
(74) *Attorney, Agent, or Firm* — KNECHTEL, DEMEUR & SAMLAN

(57) ABSTRACT

A device that can be easily and releasably fixed, moved, and reattached in any desired location on a boat; and provides for the easy attachment and securing of multiple ropes or other fastening means, at the same time, which are then attached to a single or multiple boat fender(s) or other floatation device(s) to facilitate the proper placement and location of the boat fender(s) or other floatation device(s) in relation to the boat, as needed, in that location.

8 Claims, 23 Drawing Sheets

METHOD AND APPARATUS FOR INSTALLING A BOAT FENDER

I. CROSS-REFERENCE TO RELATED APPLICATION

This patent application is a non-provisional application claiming priority from U.S. Provisional Patent Application Ser. No. 63/094,669, entitled "Method and Apparatus For Installing a Boat Bumper", filed on Oct. 21, 2020, and is fully incorporated herein by reference.

II. FIELD OF THE INVENTION

The present invention relates to devices for installing boat fender(s) or other flotation devices to a boat and, in particular, a device releaseably secured to any desired location on the boat and providing for the installation and use of boat fender(s).

III. DESCRIPTION OF THE PRIOR ART

Typically, cleats are used in almost all boats to secure boat fender(s) or other flotation device(s) to the boat. Many cleats are fixedly secured at strategic positions around the exterior of the boat (e.g, bow, stem, port, starboard) and, when needed, a rope that is attached to the boat fender or other flotation device is then wrapped or tied into some form of knot to the cleat to thereby secure the boat fender or other flotation device to the boat. While these cleats and this attachment have been around for a long time, there are inherent issues that all boat owners have lived with for this design, including at least, the following: (i) as the cleat(s) are already fixed to the boat, if a boat fender or other flotation device is needed in a location somewhere else on the boat, this area of the boat remains exposed as there is no means to easily move or reattach another cleat in that location and certainly it cannot be done at that exact moment it is needed; (ii) for many boaters, the inexperienced boater, or boaters that have difficulty with knots, trying to properly wrap or tie a rope into some form of knot to the cleat to secure the boat fender or other flotation device can be a difficult task—for these boaters, this is a difficulty not easily overcome; and (iii) as cleats are typically used to secure one boat bumper, trying to secure multiple boat bumpers or floatation devices to a single cleat is likewise difficult and not easily overcome. Thus, there is a need and there has never been disclosed Applicant's unique device for solving these problems.

IV. SUMMARY OF THE INVENTION

The present invention is a device that can be easily and releasably fixed, moved, and reattached in any desired location on a boat; and provides for the easy attachment and securing of multiple ropes or other fastening means, at the same time, which are then attached to a single or multiple boat fender(s) or other floatation device(s) to facilitate the proper placement and location of the boat fender(s) or other floatation device(s) in relation to the boat, as needed, in that location.

V. BRIEF DESCRIPTION OF THE DRAWINGS

The Description of the Preferred Embodiment will be better understood with reference to the following figures.

Figure 15:
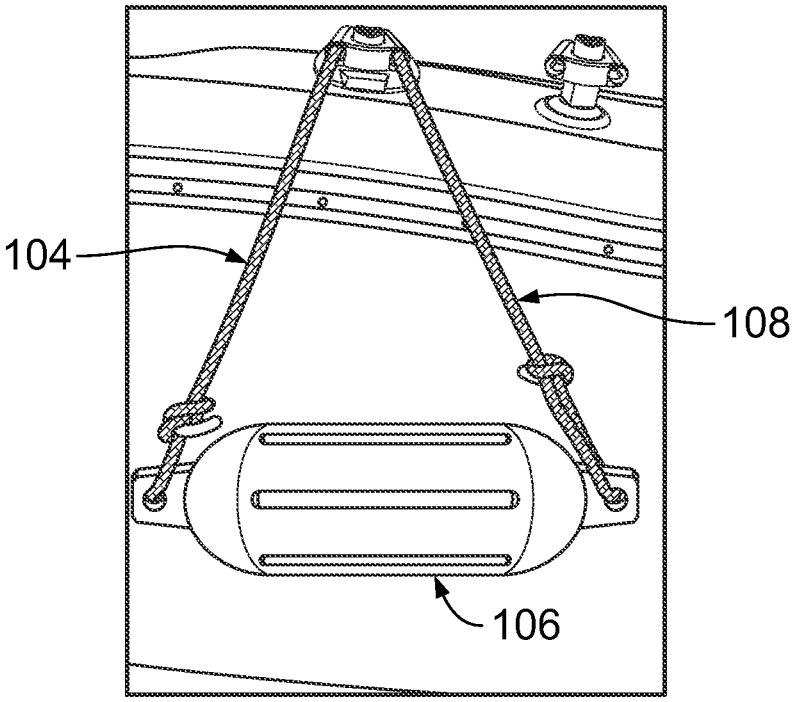

FIG. 15 is a front side perspective view of Applicant's inventive device, illustrating an alternate embodiment, having secured a first rope and a second rope or other fastening means, attached at opposite ends of a single boat fender or other floatation device within the device, and facilitating the proper placement (e.g., such as aligned horizontally in relation to the boat) and location of the boat fender or other floatation device in relation to the boat.

Figure 16:
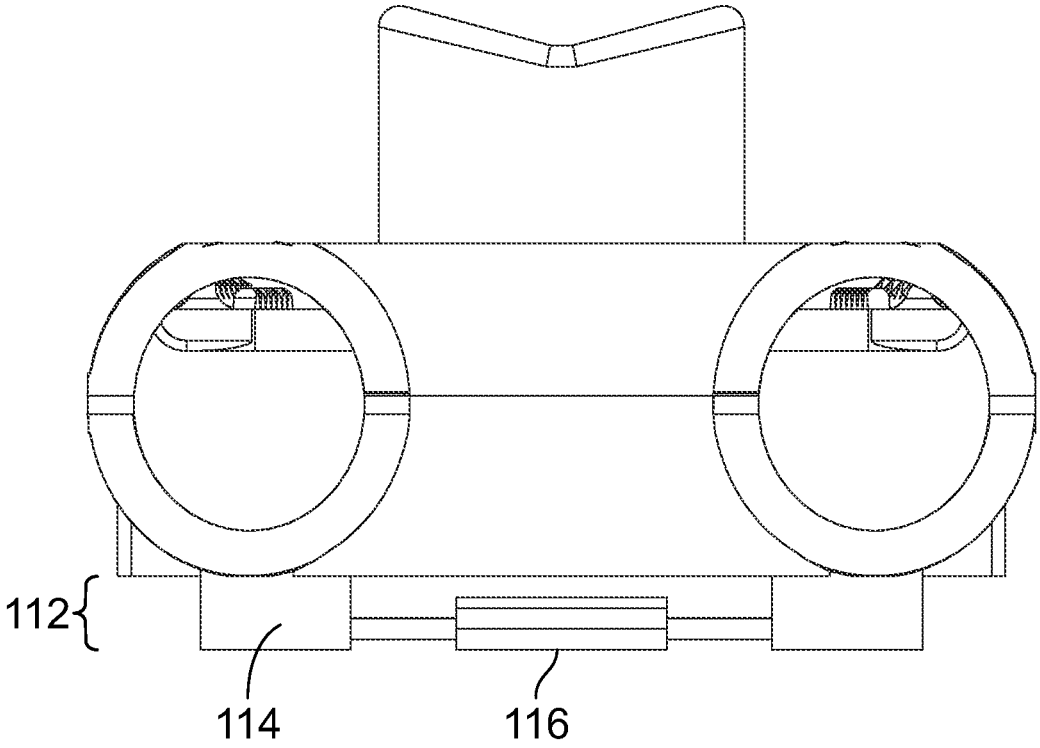

FIG. 16 is a front side perspective of an alternate embodiment of Applicant's inventive device.

Figure 17:
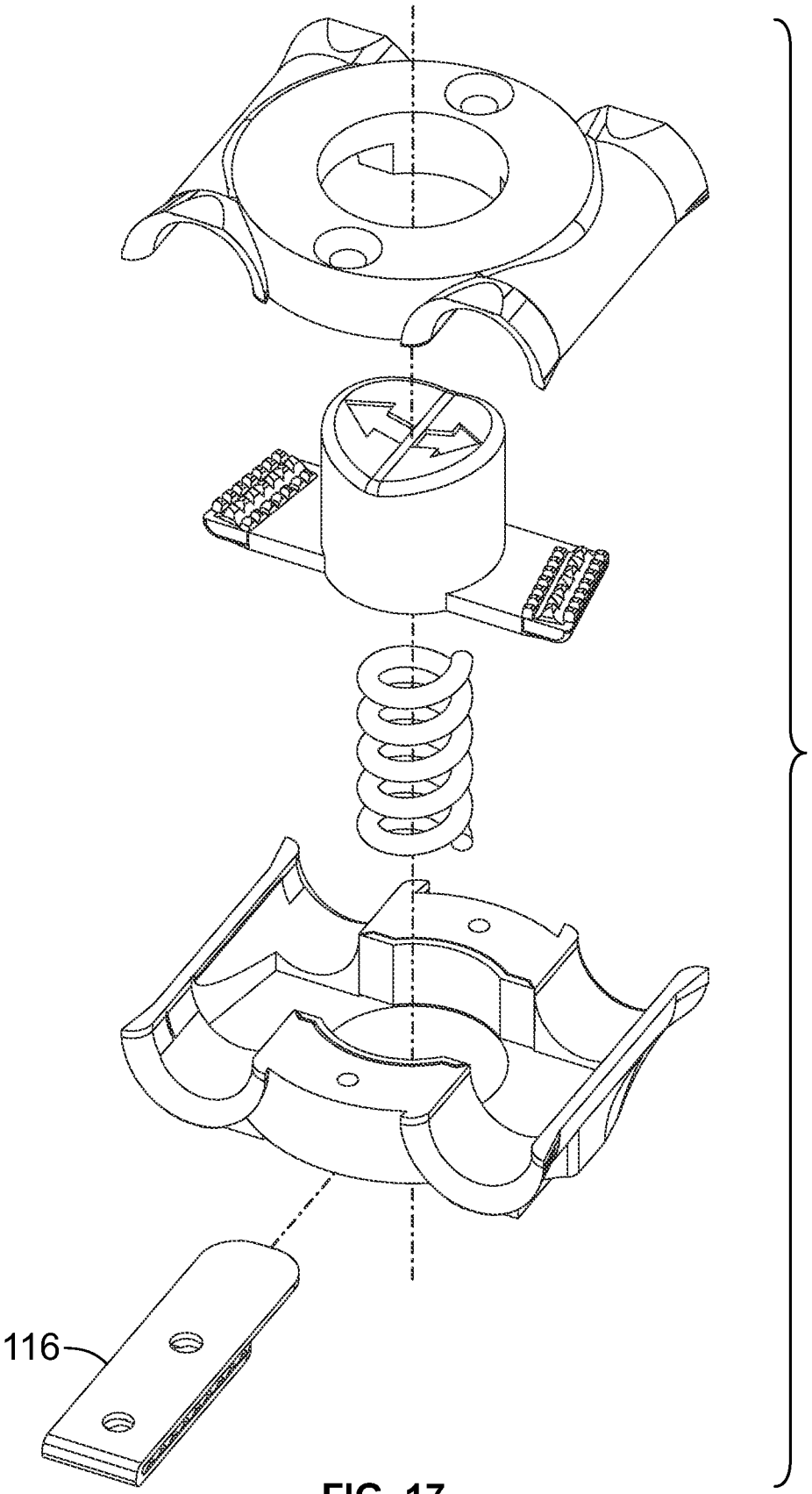

FIG. 17 is an exploded perspective view, as illustrated from the front, of the alternate embodiment of Applicant's inventive device.

Figure 18A:
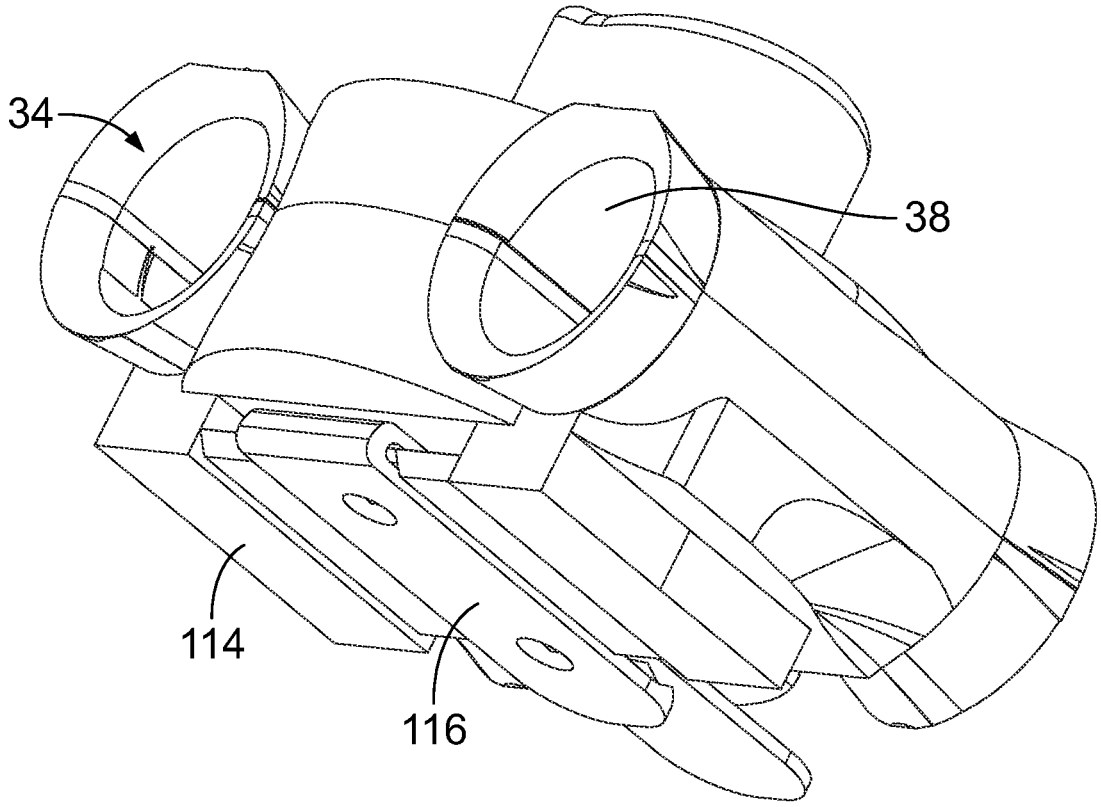

FIG. 18A is a side perspective, as illustrated from the front, of the alternate embodiment of Applicant's inventive device.

Figure 18B:
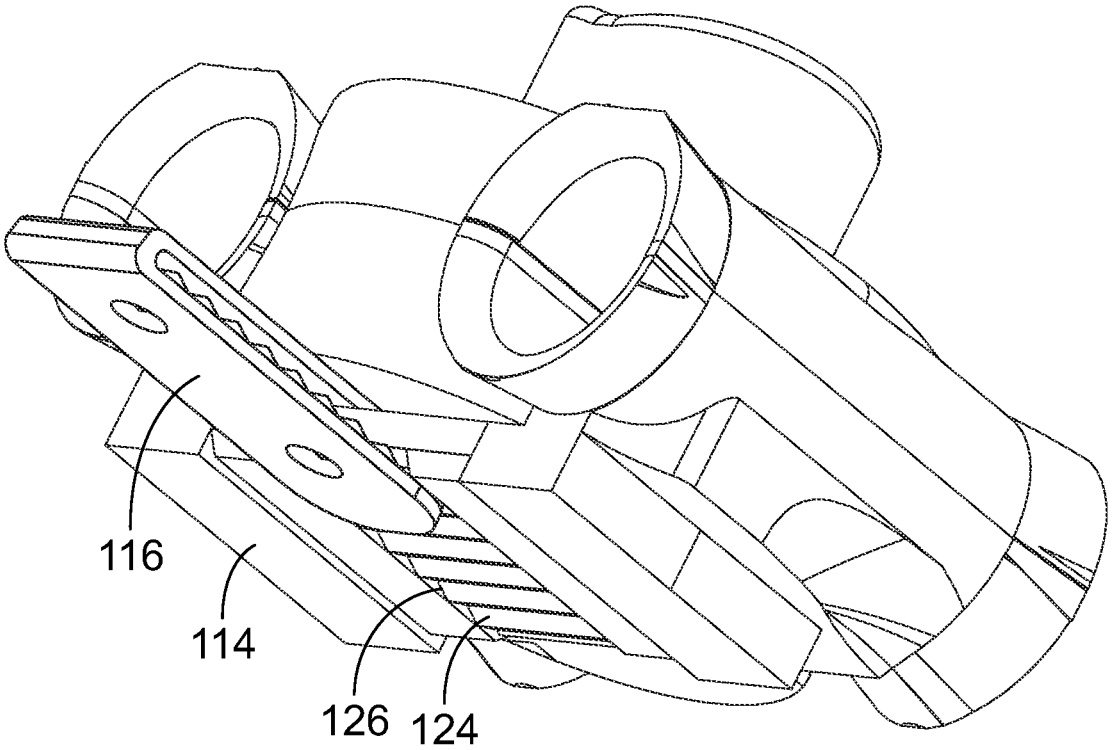

FIG. 18B is a side perspective, partially exploded, view as illustrated from the front, of the alternate embodiment of Applicant's inventive device.

Figure 19A:
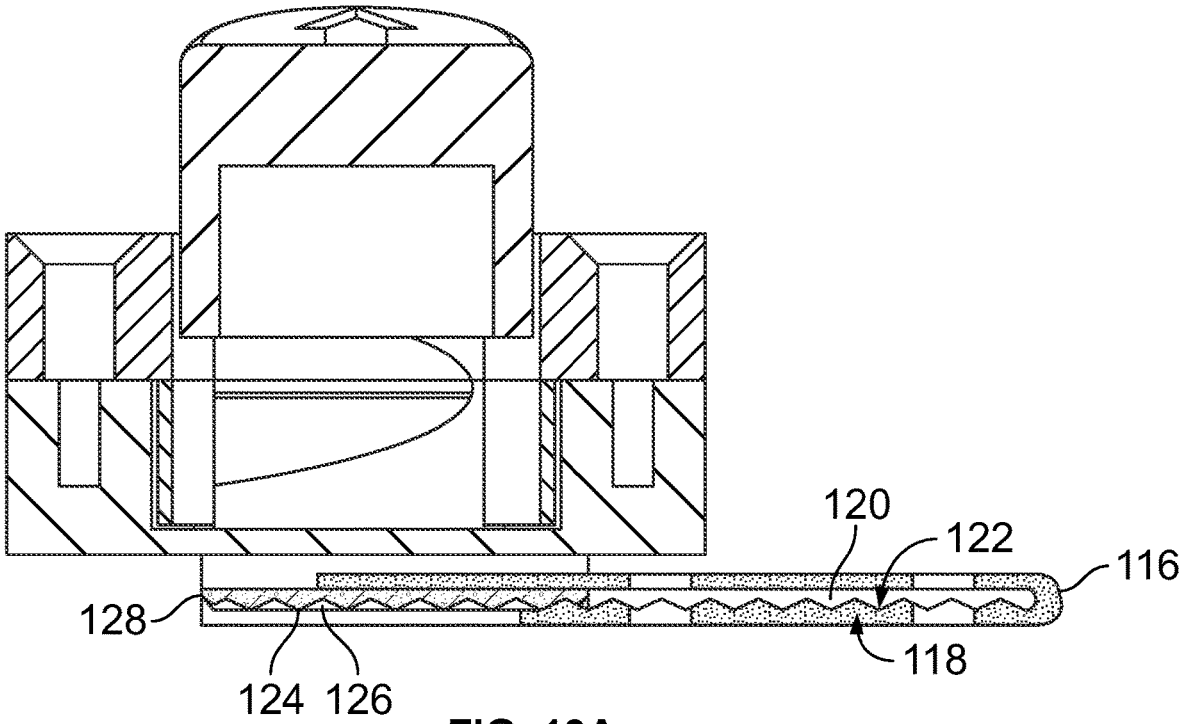

FIG. 19A is a left side cross-sectional, partially exploded, view of the alternate embodiment of Applicant's inventive device.

Figure 19B:
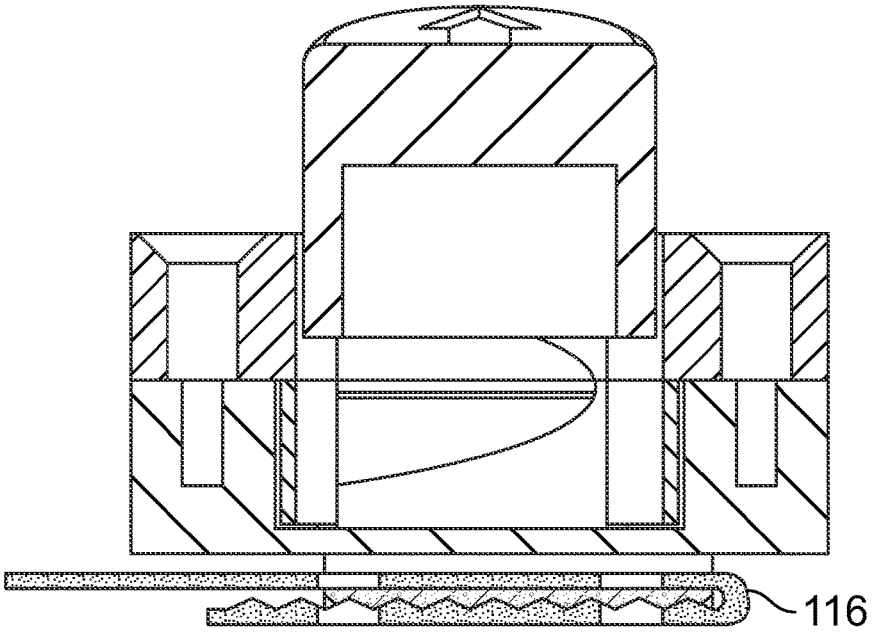

FIG. 19B is a right side cross-sectional view of the alternate embodiment of Applicant's inventive device.

Figure 20:
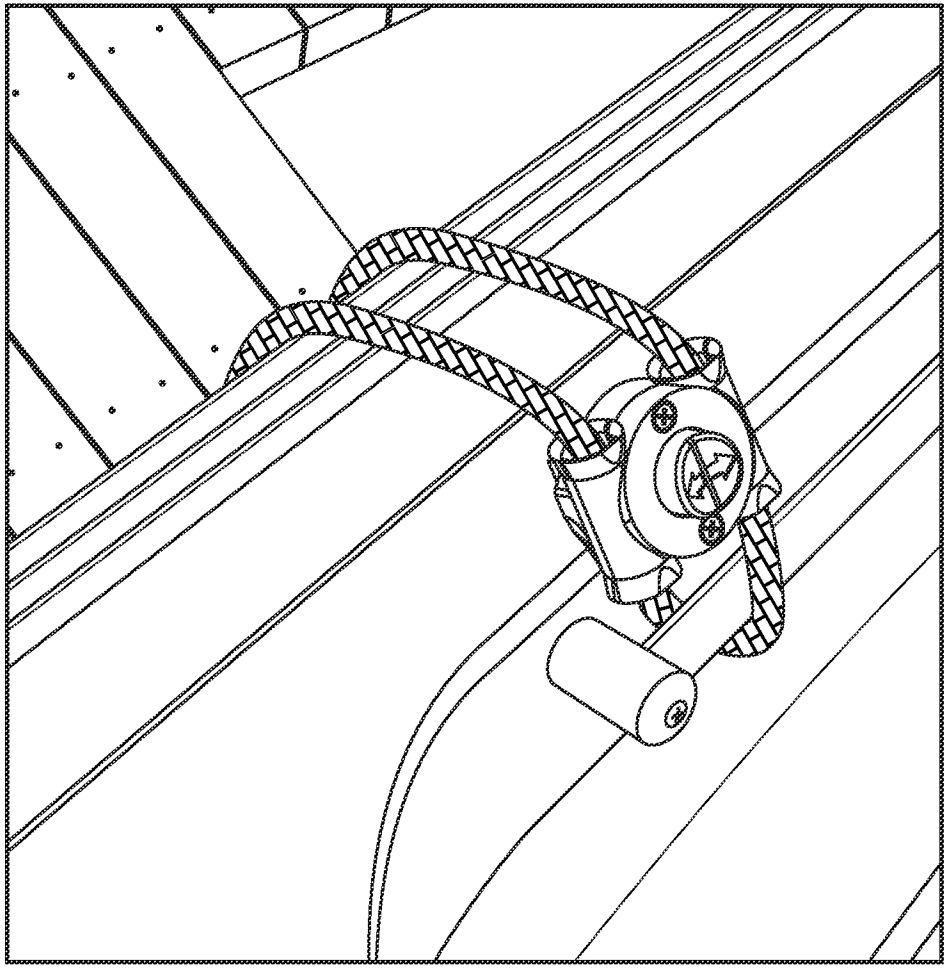

FIG. 20 is a front side perspective view of the alternate embodiment of Applicant's inventive device, illustrating an alternate embodiment for securing the inventive device to the railing of a boat using a first rope or other fastening means.

Figure 21:
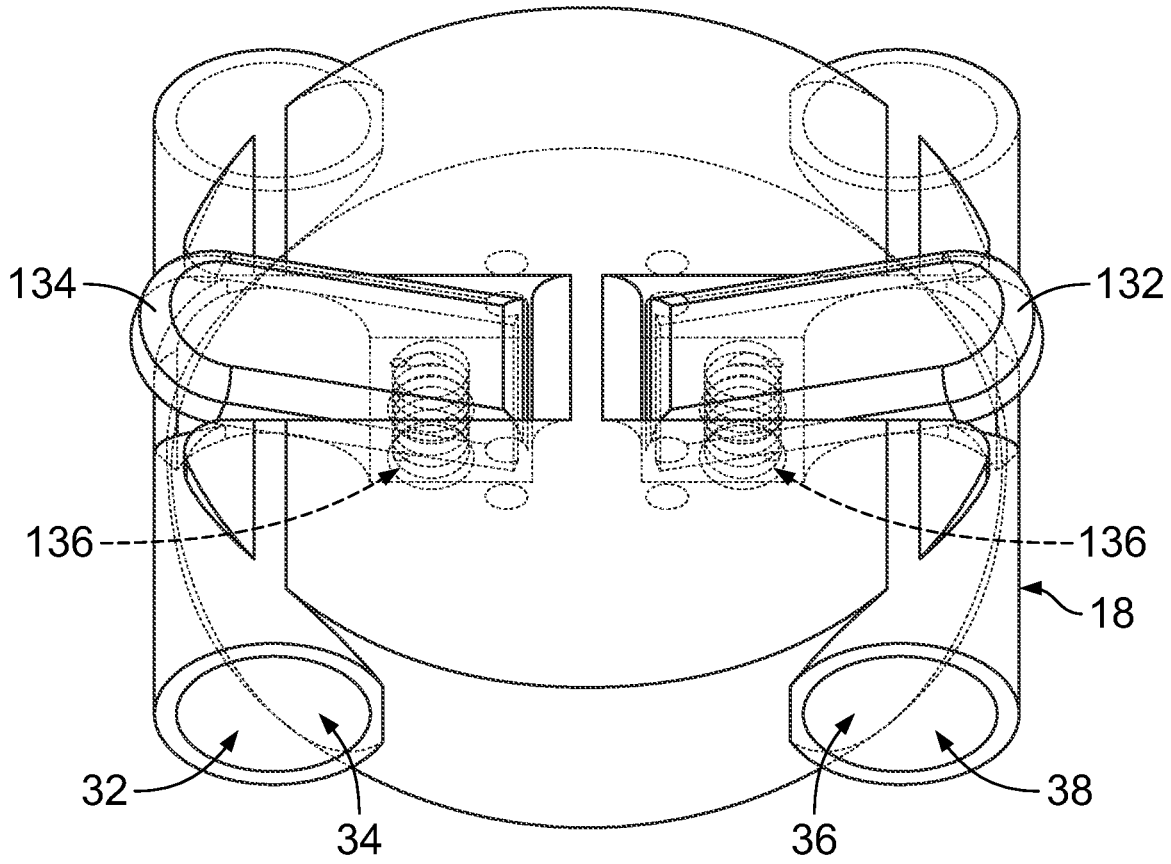

FIG. 21 is a front side perspective view of a first alternate embodiment to secure the boat fender or other flotation device to the device.

Figure 22:
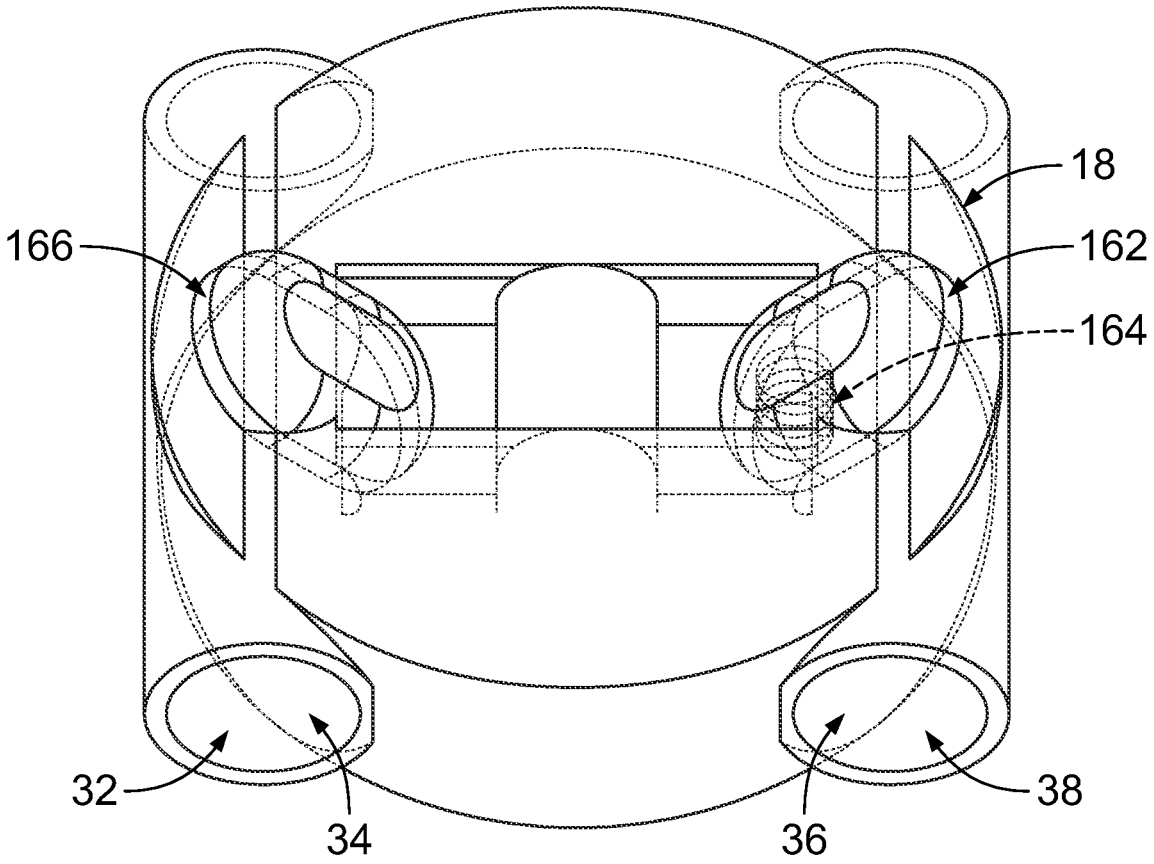

FIG. 22 is a front side perspective view of a second alternate embodiment to secure the boat fender or other flotation device to the device.

Figure 23:
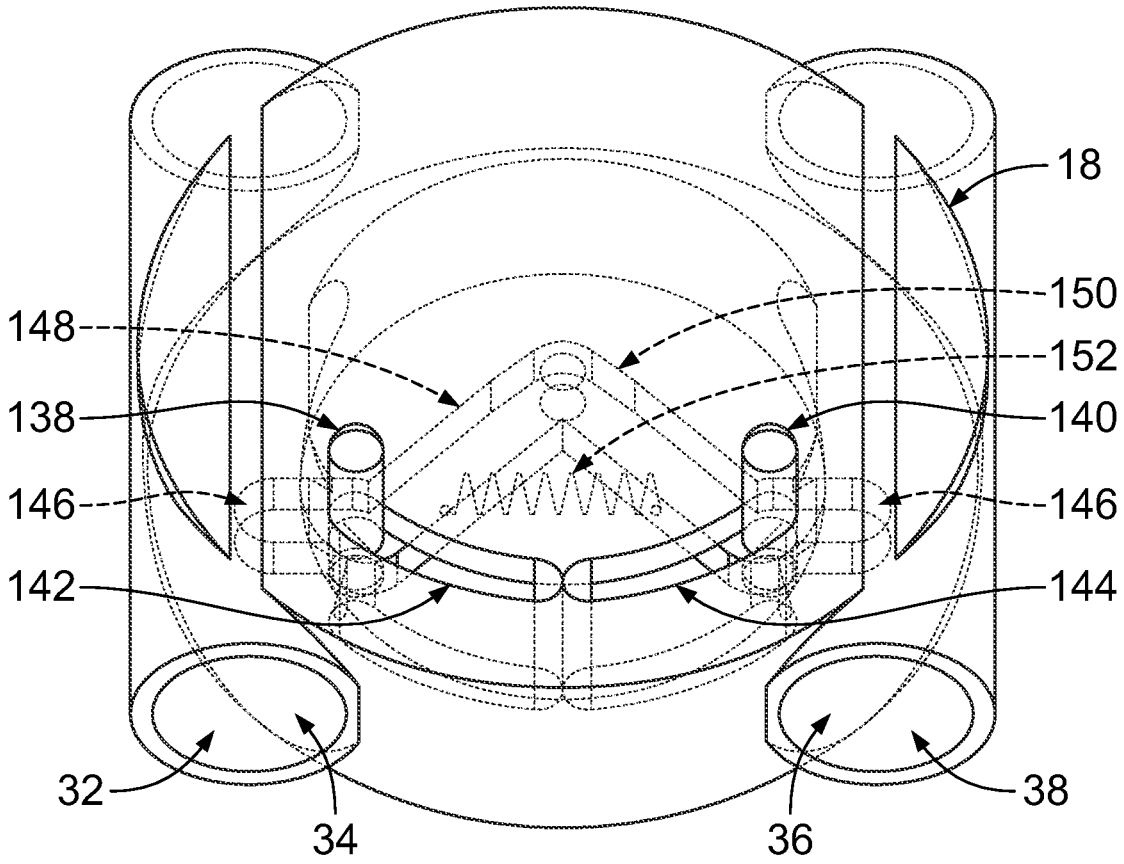

FIG. 23 is a front side perspective view of a third alternate embodiment to secure the boat fender or other flotation device to the device.

Figure 24:
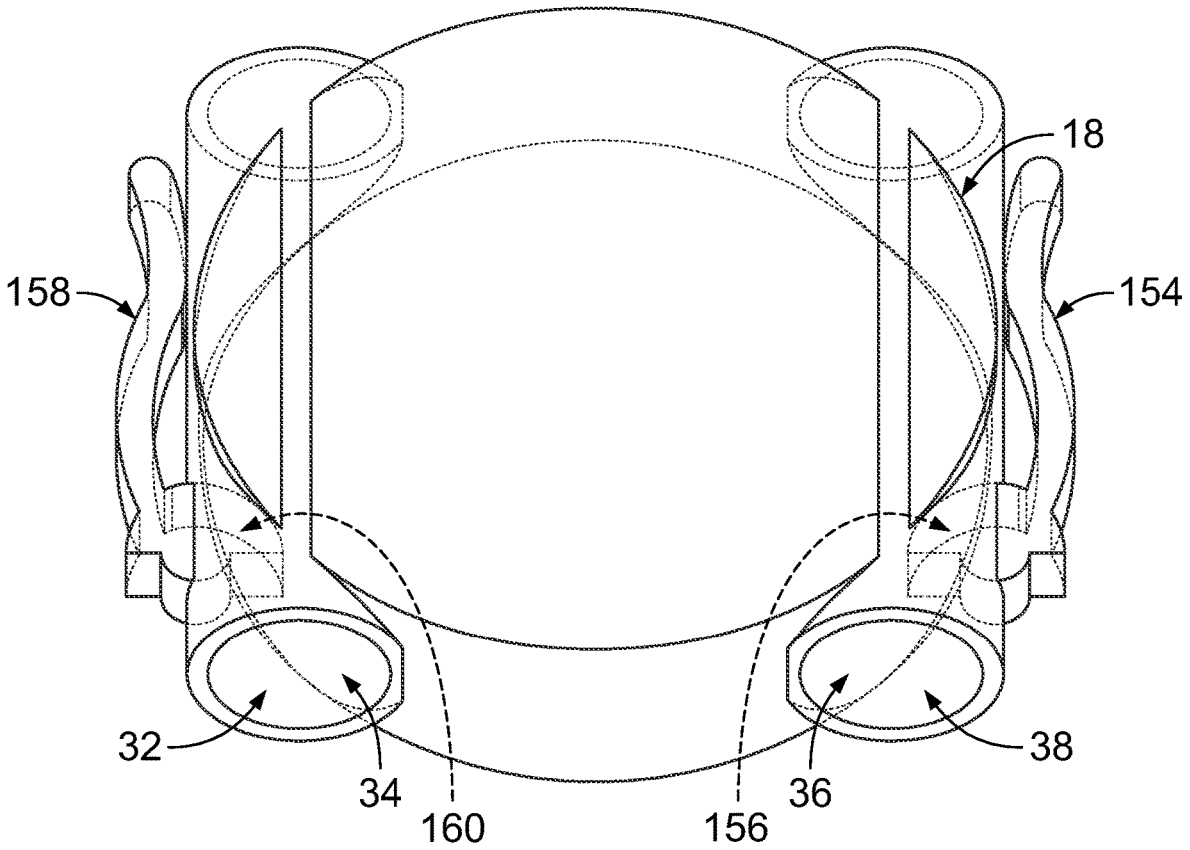

FIG. 24 is a front side perspective view of a fourth alternate embodiment to secure the boat fender or other flotation device to the device.

VI. DETAILED DESCRIPTION OF THE PREFERRED EMBODIMENT

Figure 1:
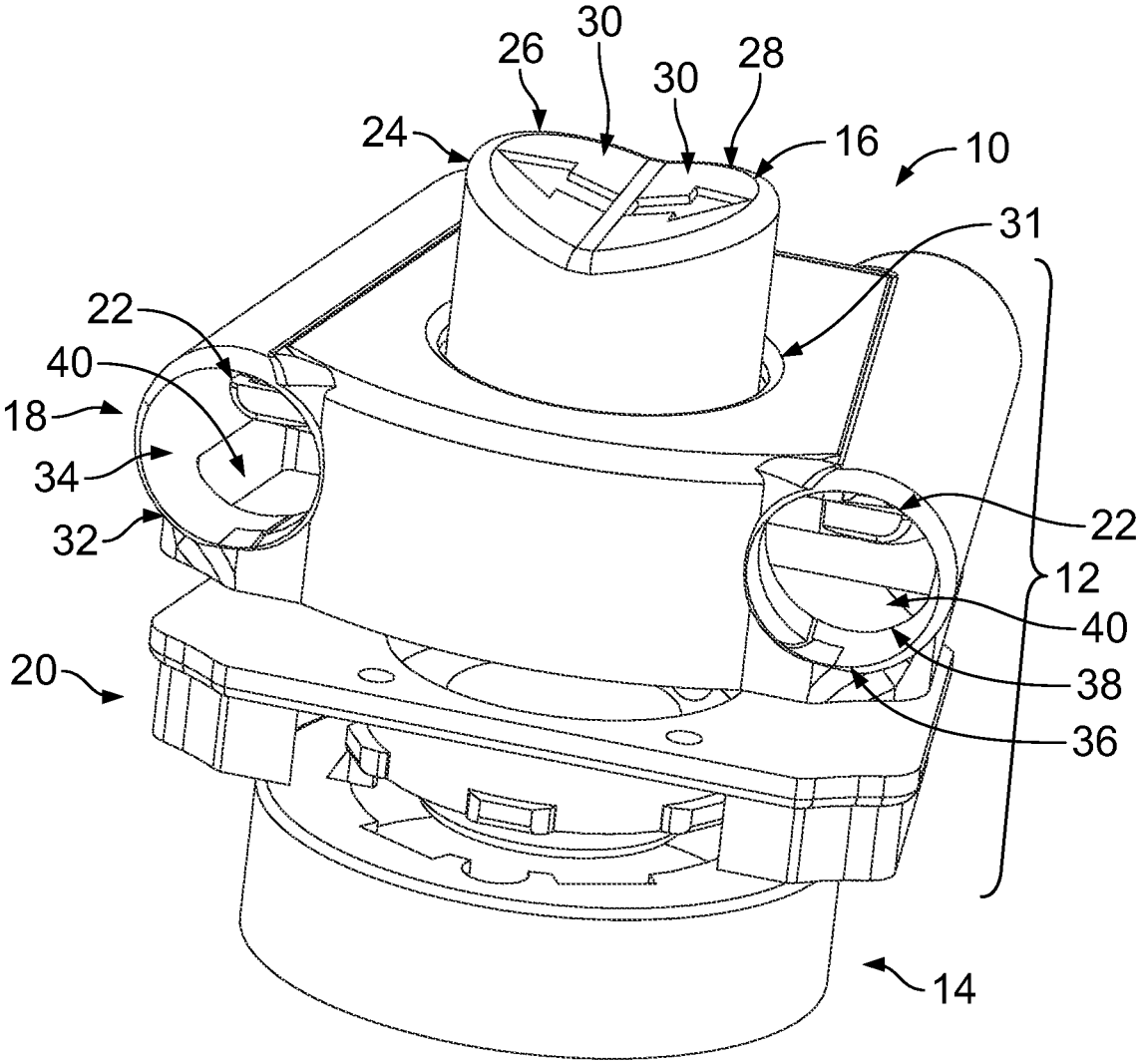
FIG. 1 is a side perspective, partially exploded view, as illustrated from the front, of Applicant's inventive device.
Figure 2:
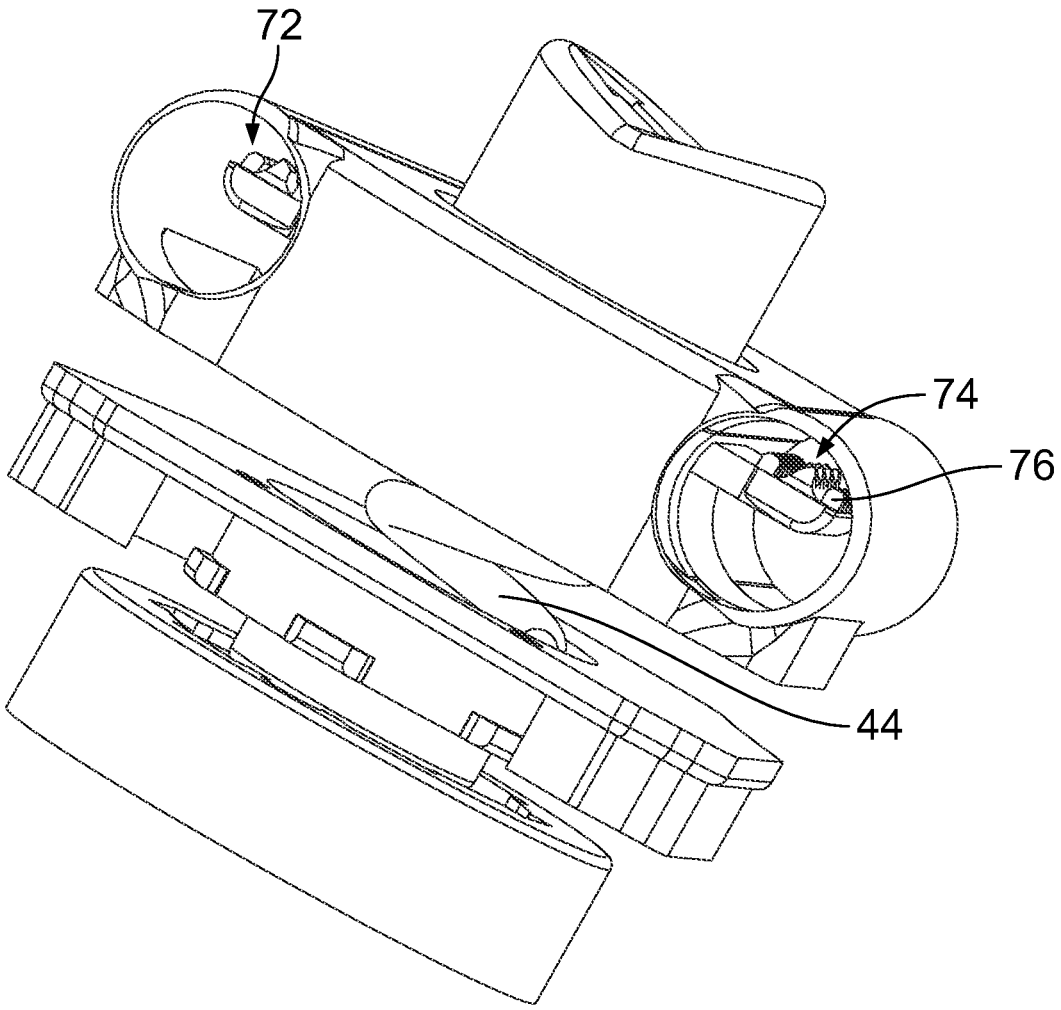
FIG. 2 is another side perspective, partially exploded view, as illustrated from the front, of Applicant's inventive device.
Figure 3:
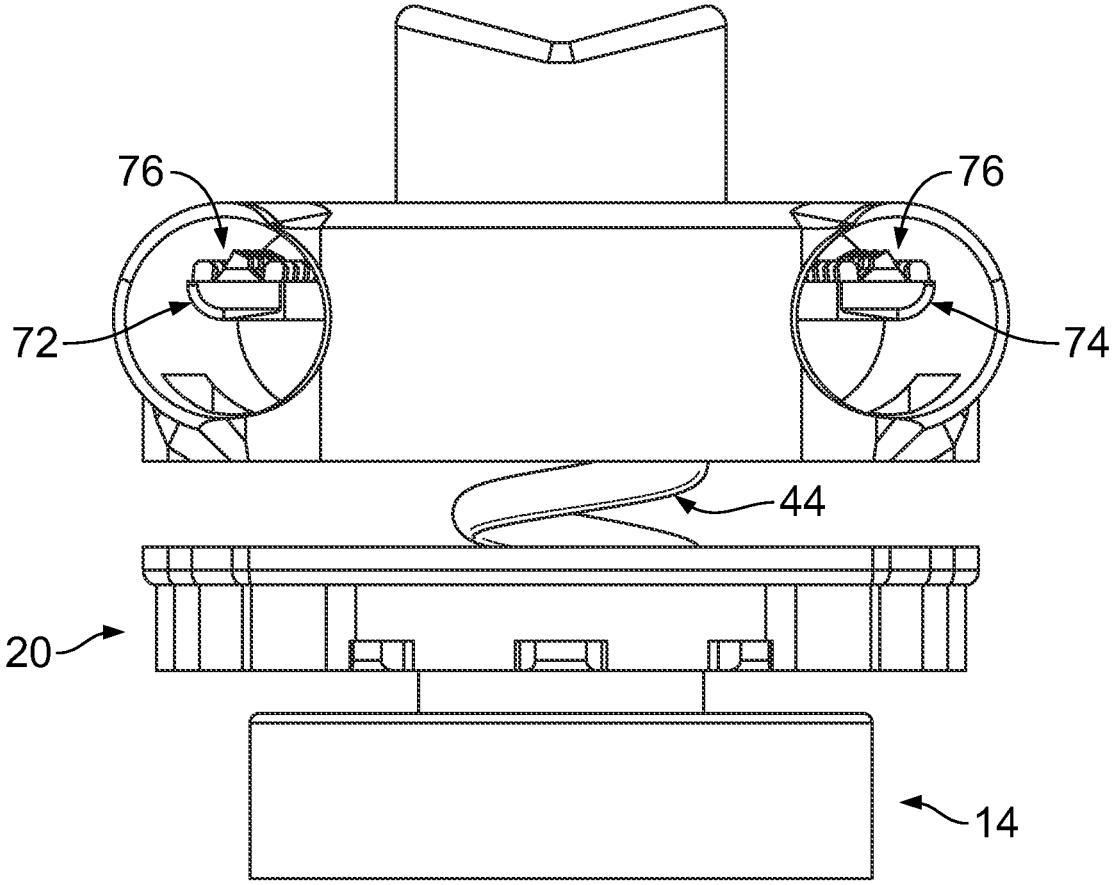
FIG. 3 is a front side perspective, partially exploded view, of Applicant's inventive device.
Figure 4:
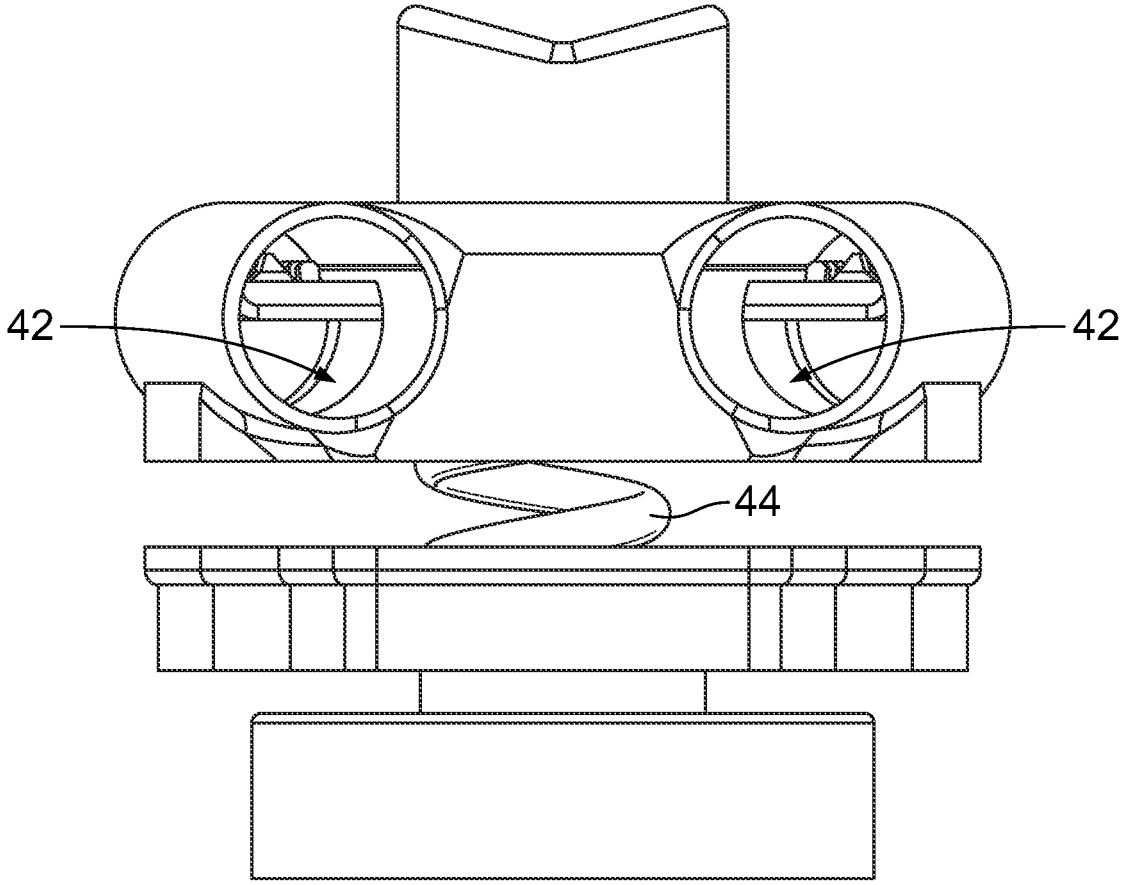
FIG. 4 is a back side perspective, partially exploded view, of Applicant's inventive device.

Turning first to FIG. 1, there is illustrated a perspective view of Applicant's inventive device 10 which comprises a housing 12 and base 14.

In the preferred embodiment, the housing 12 comprises a knob or other handle 16 secured to an elongated arm 22, an upper section 18, and a lower section 20.

Figure 5:
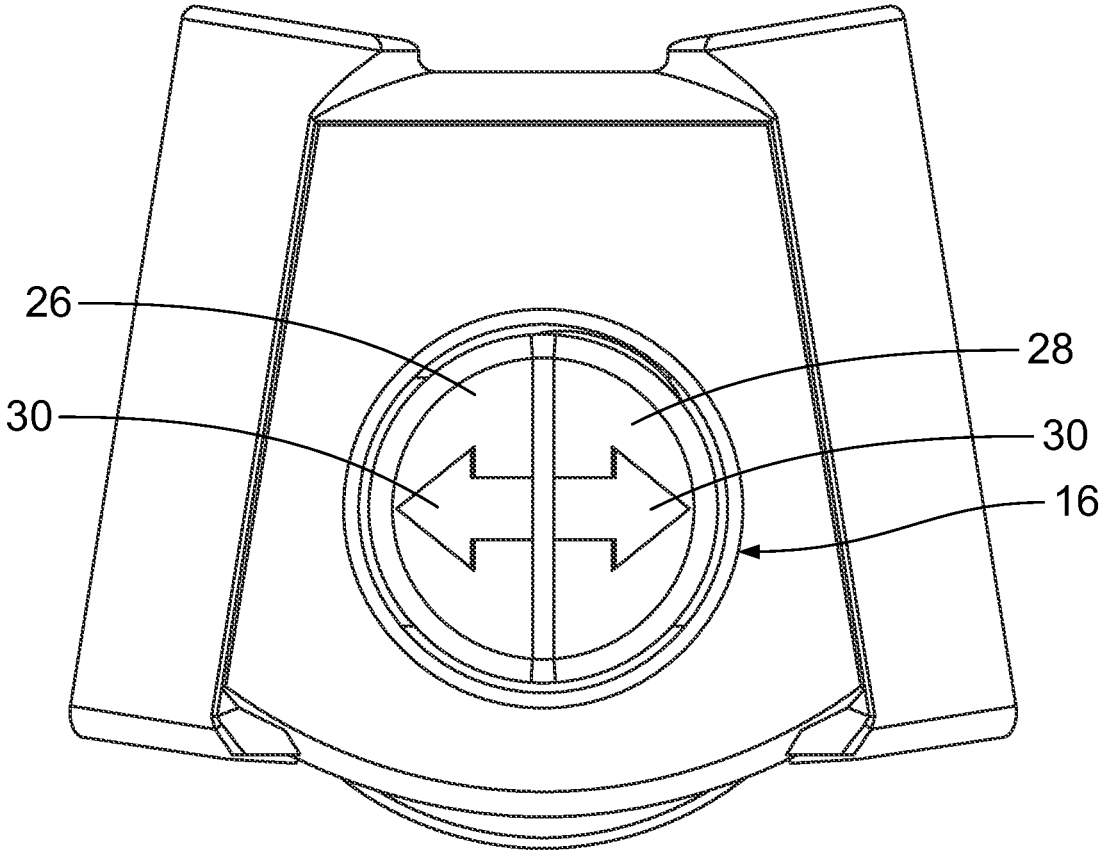
FIG. 5 is a top side perspective view of Applicant's inventive device.
Figure 6:
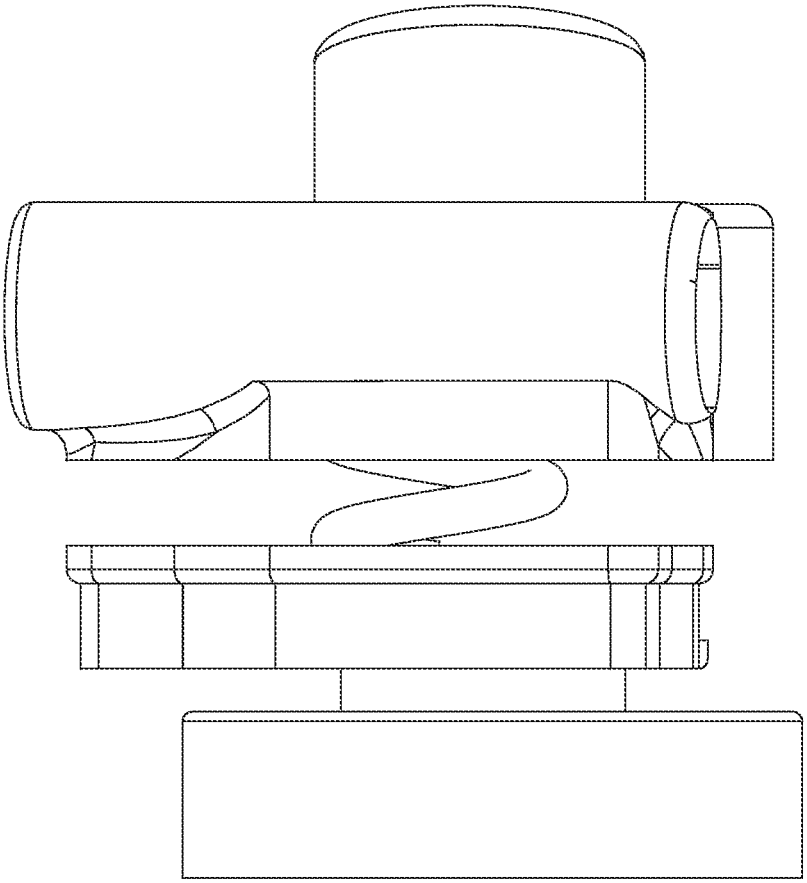
FIG. 6 is a left side perspective, partially exploded view, of Applicant's inventive device.
Figure 7:
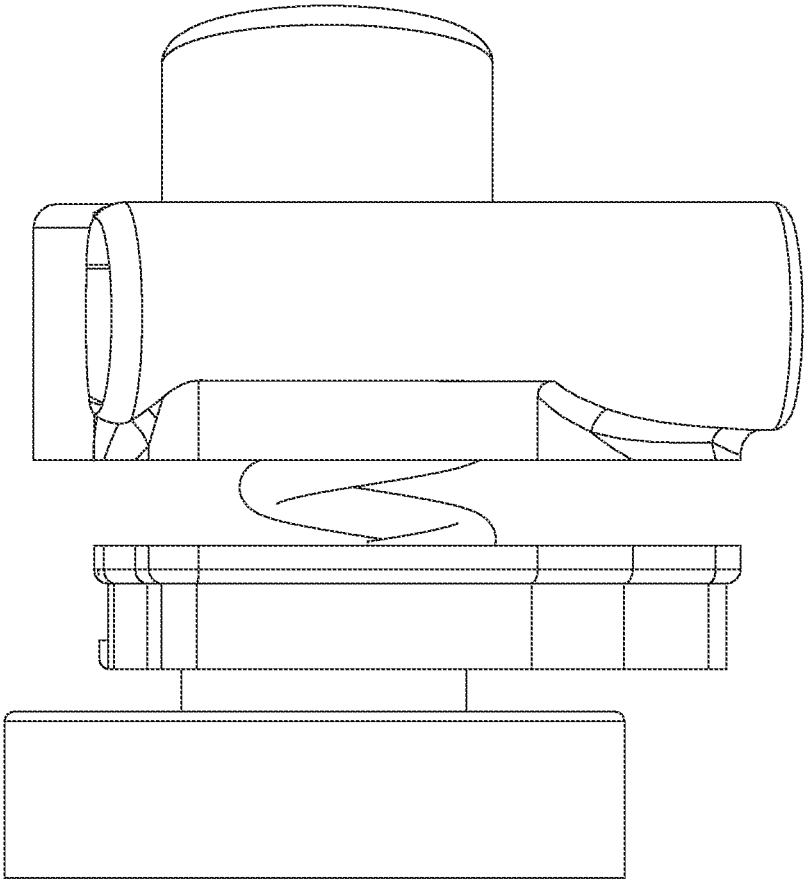
FIG. 7 is a right side perspective, partially exploded view, of Applicant's inventive device.
Figure 8:
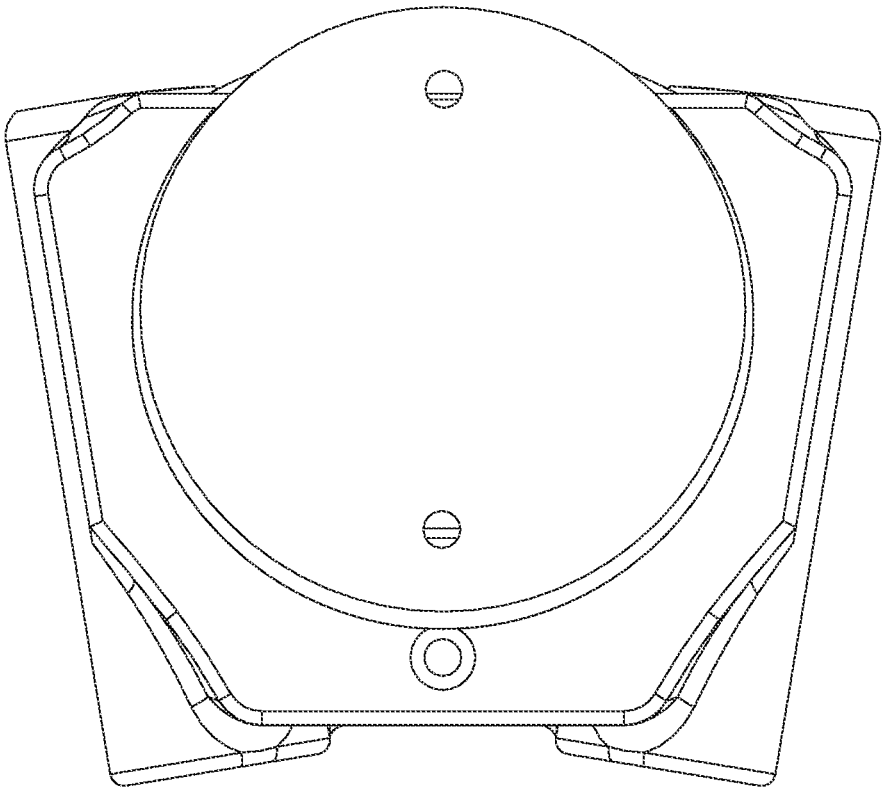
FIG. 8 is a bottom side perspective view of Applicant's inventive device.

The knob or other handle 16 is provided with a non-flat, or dual raised, top 24. In the preferred embodiment, the non-flat, or dual raised, top 24 provides a raised left portion 26 and a raised right portion 28, each with embedded indicia 30. In a non-limiting example, the embedded indicia 30 for the left portion 26 is a "left arrow" and the embedded indicia for the right portion 28 is a "right arrow" (see also FIG. 5). Alternatively, any other indicia 30 may be used as known to one skilled in the art. The knob or other handle 16 extends into, and is interconnected to, the upper section 18 through an opening 31 in the upper section 18.

The elongated arm 22 extends outwardly from the knob or other handle 16. In the preferred embodiment, the elongated arm 22 comprises a left arm 72 and a right arm 74 (see FIGS. 2-4, and 9). In the preferred embodiment, each of the left arm 72 and the right arm 74 is provided with a plurality of upwardly extending prongs 76 (see FIG. 2-4, and FIG. 9) that extends across the surface of the left arm 72 and the right arm 74 that is positioned within the left channel 34 and right channel 38, as further discussed below.

The upper section 18 is primarily hollow inside to facilitate the operation of this device 10. In the preferred embodiment, the upper section 18 comprises a left opening 32 that leads into the left channel 34, a right opening 36 that leads into the right channel 38, and a slot 42 (see FIG. 4) that intersects with a hollow passageway 40. In the preferred embodiment, the knob or other handle 16 extends into the upper section 18 through the opening 31 in the upper section 18 with the elongated arm 22, secured to and extending outwardly from the knob or other handle 16, positioned within and extending out of the slot 42 of the upper section 18 and into both of the left channel 34 and the right channel 38, respectively (see FIGS. 1-4, 11).

Figure 9:
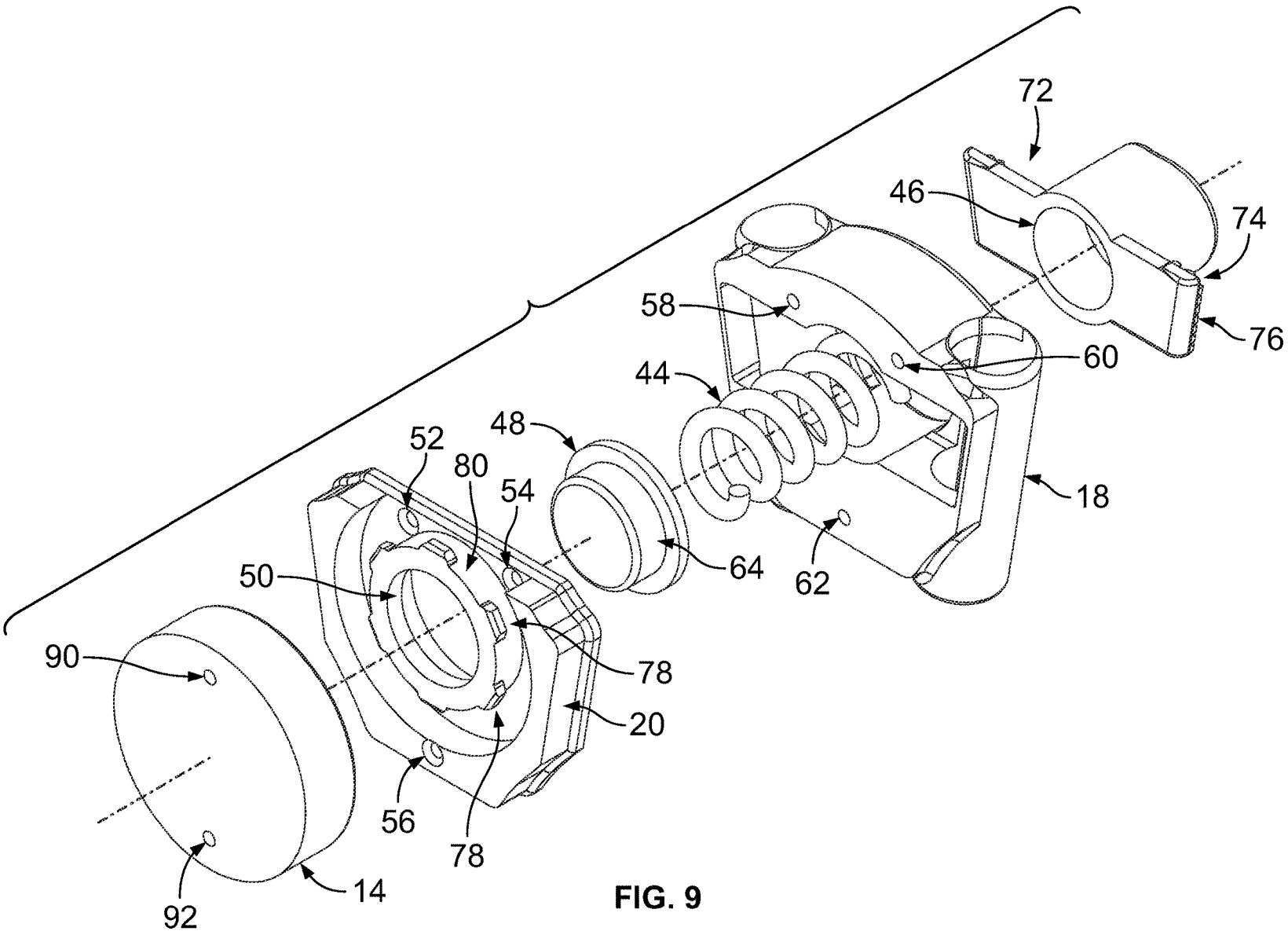
FIG. 9 is an exploded perspective view, as illustrated from the front, of Applicant's inventive device.

A compression spring 44 (see FIGS. 2-4, 6-7, 9, 11) is also positioned within the center of the upper section 18 within the slot 42 and intersecting hollow passageway 40 of the upper section 18 and likewise extends into a recess 46 inside the knob or other handle 16 (see FIG. 9). In the preferred embodiment, the compression spring 44 is also centrally located between the elongated arm 22 that extends outwardly from the knob or other handle 16.

Figure 10:
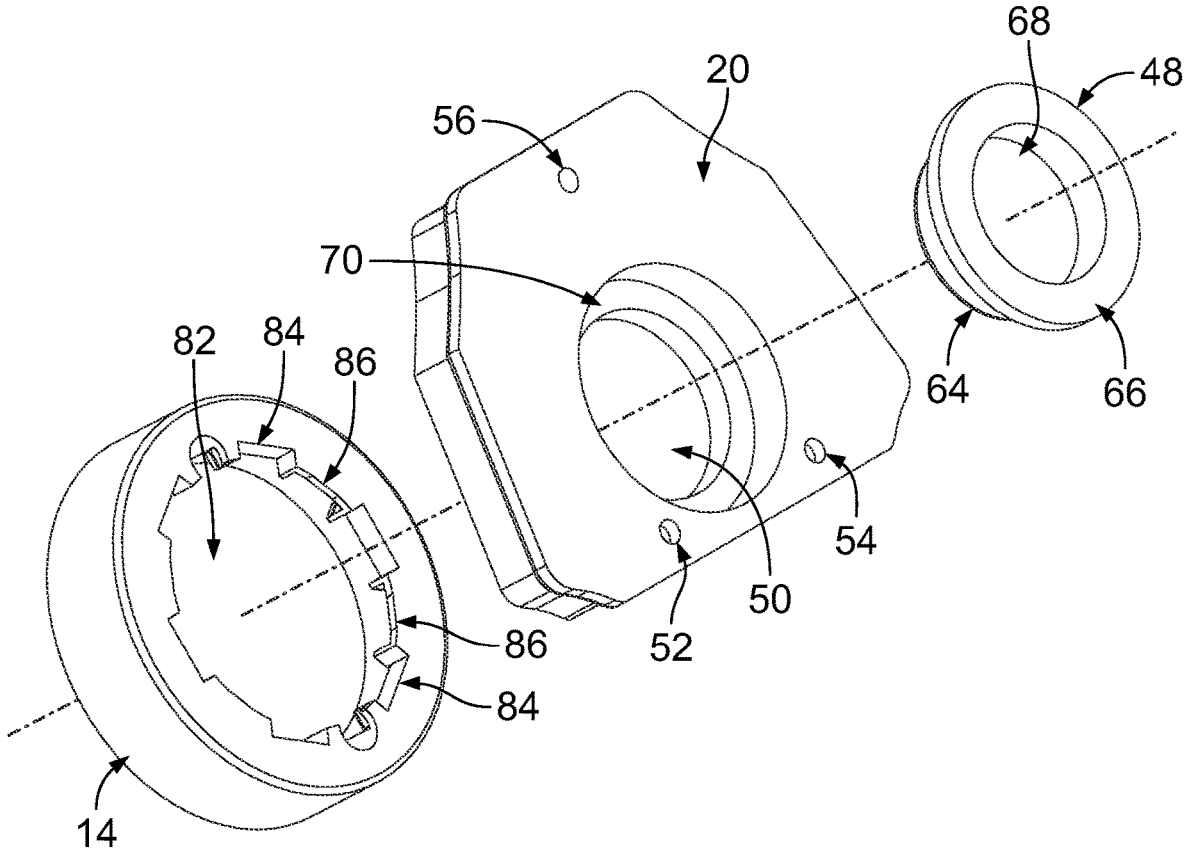
FIG. 10 is an exploded perspective view, with portions removed, of Applicant's inventive device and, in particular, illustrating the base, lower section of the housing and associated components.
Figure 11:
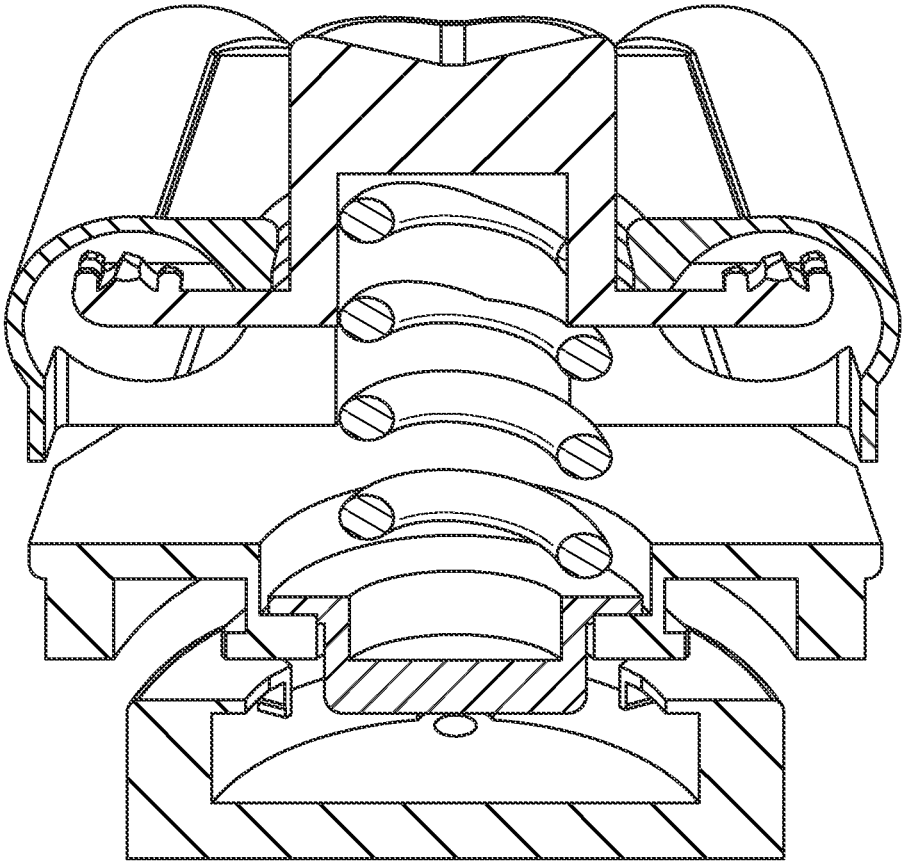
FIG. 11 is a front cross-sectional view of Applicant's inventive device.

Situated within the lower section 20 is a cap 48 (see FIGS. 9-11). The cap 48 is fitted through an opening 50 within the lower section 20. In the preferred embodiment, the cap 48 comprises a body 64, an extension ledge 66, and a recess 68 within the body 64. The body 64 is inserted into and through the opening 50 in the lower section 20 until the extension ledge 66 engages a reciprocaal internal ledge 70 (e.g., to act as a stopper) within the opening 50 thereby fitting the body 64 within the lower section 20.

The upper section 18 is releaseably affixed to the lower section 20 using opposed threaded screws (not illustrated) or any other means known to one skilled in the art (see FIG. 9). The opposed threaded screws (not illustrated) are inserted through bore holes 52, 54, and 56 in the lower section 20 that are in alignment with reciprocating threaded holes 58, 60, and 62 in the upper section 18 for frictionally receiving the threaded screws (not illustrated) and thereby releasably securing the upper section 18 to the lower section 20. Alternatively, the upper section 18 may be releaseably or fixedly secured to the lower section 20 using any means known to one skilled in the art.

The lower section 20 is releaseably affixed to the base 14. In the preferred embodiment, the lower section 20 comprises a plurality of spokes 78 extending outwardly from a central hub 80 (see FIG. 9). Upon inserting the central hub 80 of the lower section 20 into an opening 82 within the base 14 (see FIG. 10), each of the plurality of spokes 78 are inserted through a plurality of reciprocally aligned key holes 84. Once the central hub 80 of the lower section 20 is positioned within the opening 82 within the base 14 and the plurality of spokes 78 are inserted through the plurality of reciprocally aligned key holes 84, the lower section 20 is rotated within the base 14 until each of the plurality of spokes 78 are centrally aligned below a plurality of reciprocal slots 86. Once in this position and aligned, an internal compression spring (not illustrated) or other means known to one skilled in the art applies a spring force to push the lower section 20 and each of the plurality of spokes 78 to engage within or inside each of the plurality of reciprocal slots 86 in the base 14. In this manner, the lower section 20 becomes releaseably affixed to the base 14.

In the preferred embodiment, the device 10 may be secured to any desired exterior location on a boat 88. In the non-limiting examples, the device 10 as illustrated may be releaseably fixed on the top horizontal surface 94 of the side of the boat 88 (as illustrated in FIG. 12); to the vertical surface 96 of the side of the boat 88, or in any other location on the boat 88 known to one skilled in the art provided that the device 10 operates in the manner described herein.

In any of these desired locations, as illustrated in FIG. 9, the holes 90 and 92 of the base 14 may be used to releaseably secure the device 10 directly to the boat 88 or to a plate or other attachment means known to one skilled in the art (not illustrated) that is fixedly secured to the boat 88.

Figure 12:
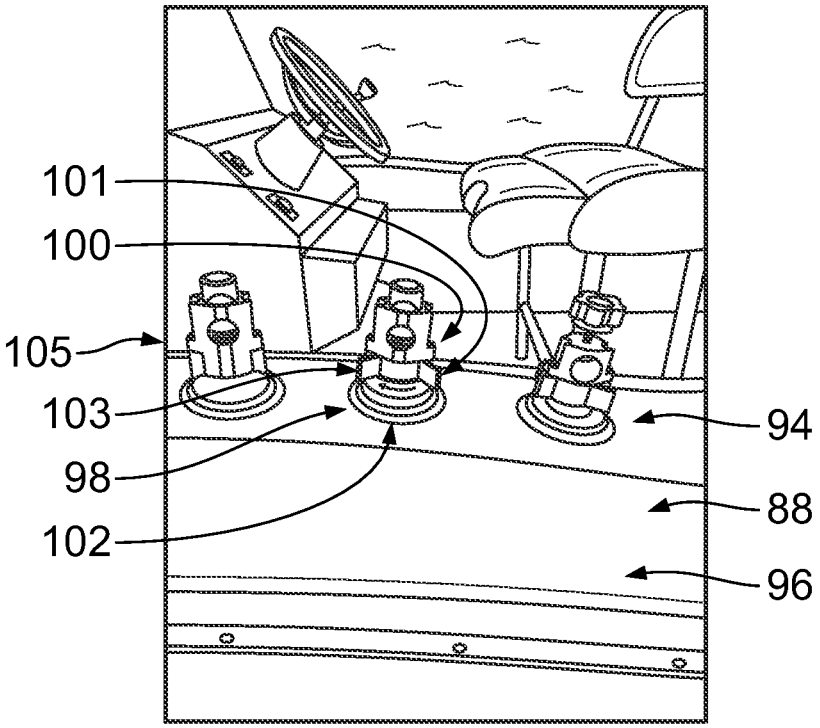
FIG. 12 is a front side perspective view of Applicant's inventive device, as illustrated with two additional embodiments for releaseably affixing to the exterior surface of a boat.

Also, as illustrated in FIG. 12, two additional, or alternate, embodiments of the inventive device 10 are illustrated for releaseably attaching the inventive device 10 to the boat 88 through suction.

Starting with the first alternate embodiment, the device 10 comprises an alternate base 98. The base 98 provides a handle or lever 100 and a suction cup or suction platform 102. The handle or lever 100 may be located anywhere on the device 10 known to one skilled in the art provided that the handle or lever 100 operates in the manner described herein. In this first alternate embodiment, the handle or lever 100 is positioned horizontally and rotated horizontally. As the handle or lever 100 is being rotated, from a first position 101 to a second position 103, this forces the suction cup or suction platform 102 to depress and suction onto the top horizontal surface 94 of the side of the boat 88. In this manner, and when the handle or lever 100 is in the second position 103, the device 10, using the base 98, is attached (through frictional suction) to the boat 88. The handle or lever 100 can then be rotated back to its first position 101 to thereby release the suction cup or suction platform 102 from the side of the boat 88. In this manner, the device 10 is likewise then released from the boat 88.

In the second alternate embodiment, as illustrated in reference 105, in lieu of the handle or lever 100, the device 10 itself could be forced downward onto the horizontal surface 94 or vertical surface 96 of the boat 88 to force the suction cup or suction platform to suction onto the surface 94, 96 and thereby releasably attaching the device 10 (through frictional suction) to the boat 88. Applying sufficient pulling force on the device 10 in the opposite direction of the boat 88, the pulling force can overcome the frictional suction of the suction cup or suction platform 102 and thereby release the suction cup or suction platform 102 from the surface 94, 96 of the boat 88. In this manner, the device 10 is likewise then released from the boat 88.

Once secured to the boat 88, the device 10 is ready for use to secure a boat fender or other flotation device 106 and 110 (see FIGS. 13-15) (e.g., both the first and second boat fenders) at a desired location 50 (see FIG. 14) along the side of the boat 88.

In use and upon applying a downward force upon the top 24 of the knob or other handle 16 (i.e., equal force upon the entire top 24 and both the left portion 26 and right portion 28), the knob or other handle 16 is depressed downward within the upper section 18 of the device 10. As this occurs, the compression spring 44, situated within the center of the upper section 18 within the slot 42 and intersecting hollow passageway 40 of the upper section 18, is compressed between the recess 46 of the knob or other handle 16 and the recess of the body 64 (see FIGS. 9, 10). Preferably, this downward force is continued to be applied upon the knob or other handle 16. As this occurs, and the compression spring 44 is continually compressed, the elongated arm 22 traverses through the slot 42 and into the hollow passageway 40 of the upper section 18 until the left arm 72 and the right arm 74 of the elongated arm 22 have recessed into the hollow passageway 40 and exited the left channel 34 and the right channel 38. When this occurs, the left channel 34 and the right channel 38 will be open through the entire device 10.

Figure 13:
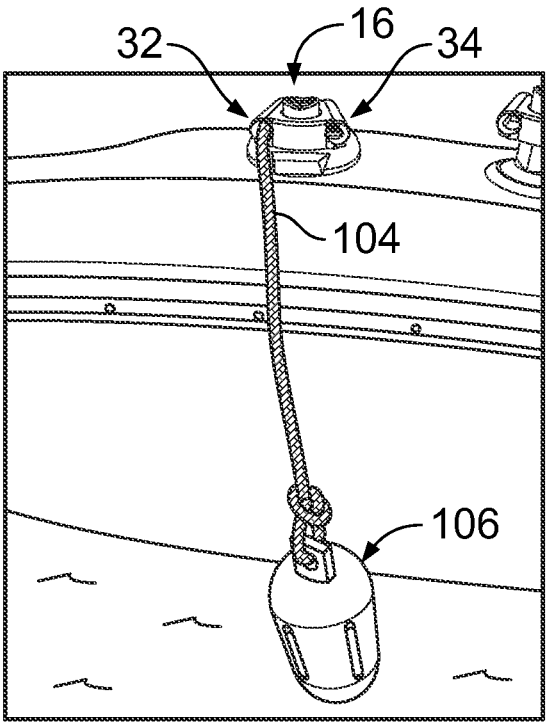
FIG. 13 is a front side perspective view of Applicant's inventive device having secured a first rope or other first fastening means attached to a first boat fender or other floatation device within the device, and facilitating the proper placement and location of the first boat fender or other floatation device in relation to the boat.
Figure 14:
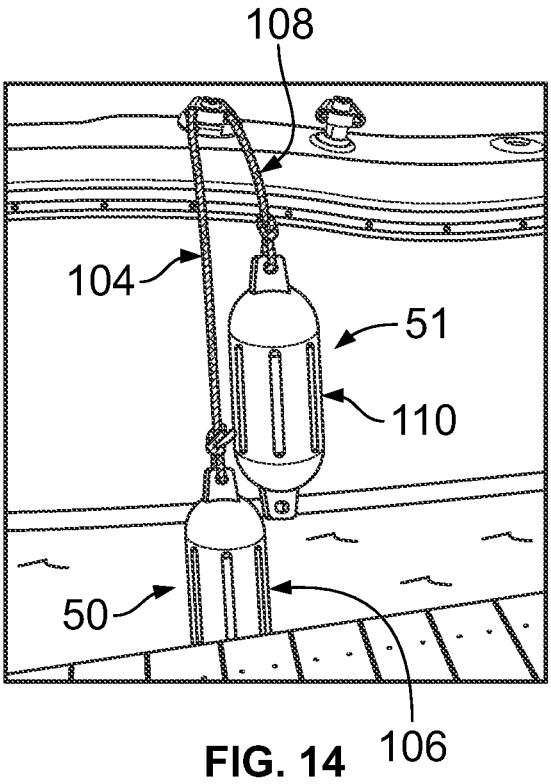
FIG. 14 is a front side perspective view of Applicant's inventive device having secured a first rope and second rope or other second fastening means attached to a first and second boat fender or other floatation device within the device, and facilitating the proper placement and location of the first and second boat fender(s) or other floatation device (s) in relation to the boat.

When the left channel 34 and the right channel 38 are open and clear, a rope 104 and 108 (e.g., a first and second rope), as illustrated in FIGS. 13 through 15, attached to a boat fender or other flotation device 106 and 110 (e.g., a first and second boat fender), is inserted into and through the left opening 32 to the left channel 34 and the right opening 36 to the right channel 38. In this manner, the rope 104 and 108 (e.g., both the first and second ropes) are continually inserted and pulled through the left channel 34 and the right channel 38 in the device 10 until the attached boat fender or other flotation device 106 and 110 (e.g., both the first and second boat fenders) are positioned at the desired location 50 along the side of the boat 88. Once this desired location 50 of the boat fender or flotation device 106 and 110 (e.g., both the first and second boat fenders) are reached, the knob or other handle 16 is released. As the knob or other handle 16 is released, the compression spring 44, having been compressed and providing an opposing force, is likewise released such that the released spring force forces the knob or other handle 16 upward causing the elongated arm 22 to exit out of the hollow passageway 40 and back into the slot 42 of the upper section 18 until the left arm 72 and the right arm 74 of the elongated arm 22 have traversed back into the left channel 34 and the right channel 38 causing the opening in the left channel 34 and right channel 38 to close. In this manner, upon the closing of the opening, the left arm 72 and the right arm 74 frictionally secures the rope 104 and 108 (e.g., both the first and second ropes) within the left channel 34 and the right channel 38 of the device 10 with the boat fender or other flotation device 106 and 110 (e.g., both the first and second boat fenders) remaining positioned at the desired location 50 along the side of the boat 88.

When the boat fender or other flotation device 106 and/or 110 is no longer desired to be used, this same process can be repeated to allow the rope 104 and 108 to be removed from the device 10 and the boat fender or other flotation device 106 and 110 removed from the boat 88.

Alternatively, upon applying a downward force upon the top 24 of the knob or other handle 16 (i.e., all the force upon the left portion 26 of the top 24 only), the knob or other handle 16 is depressed downward within the upper section 18 of the device 10. As this occurs, the compression spring 44, situated within the center of the upper section 18 within the slot 42 and intersecting hollow passageway 40 of the upper section 18, is compressed between the recess 46 of the knob or other handle 16 and the recess 68 of the body 64 (see FIGS. 9, 10). Preferably, this downward force is continued to be applied upon the knob or other handle 16 (i.e., with all the force continuing to be applied upon the left portion 26 of the top 24 only). As this occurs, and the compression spring 44 is continually compressed, the elongated arm 22 (i.e., and specifically the left arm 72) traverses downward through the slot 42 and into the hollow passageway 40 of the upper section 18 until the left arm 72 has recessed into the hollow passageway 40 and exited the left channel 34. When this occurs, the left channel 34 will be open through the entire device 10. Simultaneously, the reverse occurs with the elongated arm 22 (i.e., and specifically the right arm 74) as the right arm 74 traverses upwardly through the slot 42 with the right arm 74 pushing upwardly toward the top of the right channel 38. In this manner, the left arm 72 and the right arm 74 move in reciprocal opposite directions within the upper section 18 and the left channel 34 and right channel 38, respectively.

When the left channel 34 is open and clear, a rope 104 (e.g., a first rope), also as illustrated in FIGS. 13 through 15, attached to a boat fender or other flotation device 106 (e.g., a first boat fender), is inserted into and through the left opening 32 to the left channel 34. In this manner, the rope 104 (e.g., first rope) is continually inserted and pulled through the left channel 34 in the device 10 until the attached boat fender or other flotation device 106 (e.g., first boat fender) is positioned at the desired location 50 along the side of the boat 88. Once this desired location 50 of the boat fender or flotation device 106 is reached, the knob or other handle 16 is released. As the knob or other handle 16 is released, the compression spring 44, having been compressed and providing an opposing force, is likewise released such that the released spring force forces the knob or other handle 16 upward causing the elongated arm 22 (i.e., and specifically the left arm 72) to exit out of the hollow passageway 40 and back into the slot 42 of the upper section 18 until the left arm 72 has traversed back into the left channel 34 causing the opening in the left channel 34 to close. In this manner, upon the closing of the opening, the left arm 72 frictionally secures the rope 104 (e.g., first rope) within the left channel 34 of the device 10 with the boat fender or other flotation device 106 (e.g., first boat fender) remaining positioned at the desired location 50 along the side of the boat 88. Simultaneously, as the knob or other handle 16 is released, the compression spring 44, having been compressed and providing an opposing force, is likewise released such that the released spring force forces the knob or other handle 16 upward causing the elongated arm 22 (i.e., and specifically the right arm 74) to remain in the right channel 38 with no opening in the right channel 38. In this manner and this alternate embodiment, the rope 104 (e.g., first rope) with the boat fender or other floatation device 106 (e.g., the first boat fender) is individually secured to the boat 88.

With a first rope 104 and a first boat fender or other floatation device 106 individually secured to the boat 88 in the left channel 34 of the device 10, Applicant's device 10 is designed to secure a second rope 108 and a second boat fender or other floatation device 110 to the boat 88 using the right channel 38 of the device 10 without disrupting or releasing the first rope 104 from the device 10.

Upon applying a downward force upon the top 24 of the knob or other handle 16 (i.e., all the force upon the right portion 28 of the top 24 only), the knob or other handle 16 is depressed downward within the upper section 18 of the device 10. As this occurs, the compression spring 44, situated within the center of the upper section 18 within the slot 42 and intersecting hollow passageway 40 of the upper section 18, is compressed between the recess 46 of the knob or other handle 16 and the recess 68 of the body 64 (see FIGS. 9, 10). Preferably, this downward force is continued to be applied upon the knob or other handle 16 (i.e., with all the force continuing to be applied upon the right portion 28 of the top 24 only). As this occurs, and the compression spring 44 is continually compressed, the elongated arm 22 (i.e., and specifically the right arm 74) traverses downward through the slot 42 and into the hollow passageway 40 of the upper section 18 until the right arm 74 has recessed into the hollow passageway 40 and exited the right channel 38. When this occurs, the right channel 38 will be open through the entire device 10. Simultaneously, the reverse occurs with the elongated arm 22 (i.e., and specifically the left arm 72) as the left arm 72 is forced to traverse upwardly through the slot 42 with the left arm 72 pushing upwardly toward the top of the left channel 34 and continuing to apply a securing force upon the first rope 104. In this manner, the left arm 72 and the right arm 74 move in reciprocal opposite directions within the upper section 18 and the left channel 34 and right channel 38, respectively. As a result, this causes the left arm 72 to continually to frictionally secure the rope 104 (e.g., first rope) within the left channel 34 of the device 10 with the boat fender or other flotation device 106 (e.g., first boat fender) remaining positioned at the desired location 50 along the side of the boat 88.

When the right channel 38 is open and clear, also as illustrated in FIGS. 13 through 15, a rope 108 (e.g., a second rope), attached to a boat fender or other flotation device 110 (e.g., a second boat fender), is inserted into and through the right opening 36 to the right channel 38. In this manner, the rope 108 (e.g., second rope) is continually inserted and pulled through the right channel 38 in the device 10 until the attached boat fender or other flotation device 110 (e.g., second boat fender) is positioned at the desired location 51 along the side of the boat 88. Once this desired location 51 of the boat fender or flotation device 110 is reached, the knob or other handle 16 is released. As the knob or other handle 16 is released, the compression spring 44, having been compressed and providing an opposing force, is likewise released such that the released spring force forces the knob or other handle 16 upward causing the elongated arm 22 (i.e., and specifically the right arm 74) to exit out of the hollow passageway 40 and back into the slot 42 of the upper section 18 until the right arm 74 has traversed back into the right channel 38 causing the opening in the right channel 38 to close. In this manner, upon the closing of the opening, the right arm 74 frictionally secures the rope 108 (e.g., second rope) within the right channel 38 of the device 10 with the boat fender or other flotation device 110 (e.g., second boat fender) remaining positioned at the desired location 51 along the side of the boat 88. Simultaneously, as the knob or other handle 16 is released, the compression spring 44, having been compressed and providing an opposing force, is likewise released such that the released spring force forces the knob or other handle 16 upward causing the elongated arm 22 (i.e., and specifically the left arm 72) to remain in the left channel 34 with no opening in the left channel 34. In this manner, the rope 104 (e.g., first rope) with the boat fender or other floatation device 106 (e.g., the first boat fender) remains individually secured to the boat 88 while the rope 108 (e.g., second rope) and the boat fender or other flotation device 110 (e.g., second boat fender) are secured to the device 10. This is more clearly illustrated in FIG. 14, and in a non-limiting example, the boat fender or other floatation device 106 (e.g., the first boat fender) and the boat fender or other flotation device 110 (e.g., second boat fender) are shown illustrated at a vertical angle to the water (i.e., or perpendicular to the side of the boat 88).

Applicant's invention and device 10 may also be used to secure the rope 104 (e.g., first rope) and the rope 108 (e.g., second rope), both secured at opposite ends of the same boat fender or other flotation device 106 (e.g., single boat fender) to secure this single boat fender or other flotation device 106 at various angles to the boat 88. In a non-limiting example of FIG. 15, this single boat fender or other flotation device 106 is shown illustrated at a horizontal angle to the water (i.e., or parallel to the side of the boat 88). Alternatively, Applicant's device may also be used to position the boat fender or other flotation device 106 at any angle between a vertical angle to the water (i.e., or perpendicular to the side of the boat 88) and a horizontal angle to the water (i.e., or parallel to the side of the boat 88).

In an alternate embodiment, a different base means 112 may be used to frictionally secure the device 10 to the boat 88. In this alternate embodiment, the base means 112 comprises a base 114 and a clip 116, as illustrated in FIGS. 16 through 19.

The clip 116 is preferably frictionally engaged and secured to the base 114 by inserting the clip 116 over the base 114. As this occurs, a bottom portion 118 of the clip 116 provides a plurality of teeth or wedge-shaped extensions 120 separated by a plurality of wedge-shaped recesses 122. While the clip 116 is being inserted over the base 114, as illustrated in FIGS. 18B and 19A, each of these teeth or wedge-shaped extensions 120 are in alignment with and forced over reciprocal teeth or reciprocal wedge-shaped extensions and reciprocal wedge-shaped recesses 126 extending from the top portion 128 of the base 114.

Once the clip 116 is fully inserted over the base 114, or inserted as far as desired, as illustrated in FIGS. 18A and 19B, the teeth or wedge-shaped extensions 120 from the bottom portion 118 of the clip 116 are then engaged and received into the corresponding reciprocal wedge-shaped recesses 126 in the top portion 128 of the base 114 and the wedge-shaped recesses from the bottom portion 118 of the clip 116 likewise engage and receive the corresponding reciprocal teeth or wedge-shaped extensions 124 from the top portion 128 of the base 114.

Using the holes 130 in the clip 116, screws or any other fastening means (not illustrated) may be used to secure the clip 116 to the top horizontal surface 94 or vertical surface 96 (see FIG. 12) of the boat 88.

As a result, the clip 116, which is securely attached to the boat 88, can be now frictionally attached to the base 114 and housing 12 and thereby secure the device 10 to the boat 88, as illustrated in FIG. 19B (fully secured to one another). When it is desired to remove the device 10 (e.g., base 114 and housing 12) from the boat 88, the device 10 (e.g., specifically the base 114 and housing 12) are lifted in an upward direction away from the boat 88. When this occurs, this releases (and disengages) the reciprocal wedge-shaped extensions 124 of the base 114 from the corresponding wedge-shaped recesses 122 in the clip 116 and likewise releases (and disengages) the teeth or wedge-shaped extensions 120 in the clip 116 from the corresponding reciprocal wedge-shaped recesses 126 of the base 114. Upon the release and disengagement, the device 10 (e.g., base 114 and housing 12) can be pulled backward or traversed in the opposite direction of insertion to remove the base 114 from the clip 116.

In FIG. 20, in this alternate embodiment illustrates another means for securing the device 10 to the railing of the boat 88 using a rope 104 or 108 where the rope 104 or 108, being secured within one of the channels (e.g., either the left channel 34 or right channel 38) of the device 10, as disclosed herein, wrapped around the railing of the boat 88, and then secured to the opposite channel (e.g., either the left channel 34 or right channel 38), to thereby secure the device 10 to the railing of the boat 88. Additionally, the device 10, and specifically the upper section 18 and lower section 20 may each be provided with a curvilinear indentation, in alignment with one another, that can then receive the railing of the boat 88 (e.g., such that the railing of the boat 88 is fitted within the curvilinear indentation of each upper section 18 and lower section 20). In this manner, the device 10, and in particular the curvilinear indentations in each of the upper section 18 and lower section 20, are abutted up against and flush with the railing of the boat 88 to work in combination with the rope 104 or 108 when securing the device 10 to the railing of the boat 88.

In other alternate embodiment(s), various different means may be used to frictionally secure, or otherwise secure, the boat fender or other flotation device 106 and 110 (see FIGS. 13-15) (e.g., both the first and second boat fenders) to the device 10, as illustrated in FIGS. 21 through 24, or as otherwise known to one skilled in the art.

In FIG. 21, upon applying an upward, lifting force upon the right lever 132, the right lever 132 is raised upward and extended outward from the upper section 18 of the device 10. As this occurs, a retracting or recoil spring 136, affixed to the right lever 132 and upper section 18, is expanded or stretched between the right lever 132 and the upper section 18 causing a reciprocal retracting or pulling force upon the right lever 132 as it is being lifted. Preferably, this retracting or reciprocal pulling force is continued to be applied upon the right lever 132. When the lifting of the right lever 132 exits the upper section 18 of the device 10, the right channel 38 will be open through the entire device 10. When the right channel 38 is open and clear, the rope 104 or 108, for example as illustrated in FIGS. 13 through 15, attached to a boat fender or other flotation device 106 or 110, can be inserted into and through the right opening 36 to the right channel 38. In this manner, the rope 104 or 108 are continually inserted and pulled through the right channel 38 in the device 10 until the attached boat fender or other flotation device 106 or 110 are positioned at the desired location 50 along the side of the boat 88. Once this desired location 50 of the boat fender or flotation device 106 or 110 is reached, the right lever 132 is released. As the right lever 132 is released, the retracting or recoil spring 136, having been expanded or stretched and providing an opposing retracting or reciprocal pulling force, is likewise released such that the pulling force of the retracting or recoil spring 136 forces the right lever 132 downward causing the right lever 132 to enter back into the upper section 18 and back into the right channel 38 causing the opening in the right channel 38 to close. In this manner, upon the closing of the opening, the right lever 132 frictionally secures the rope 104 or 108 within the right channel 38 of the device 10 with the boat fender or other flotation device 106 or 110 remaining positioned at the desired location 50 along the side of the boat 88. The same process is performed to release the rope 104 or 108. Additionally, the mechanics and process works the exact same for the left lever 134 in connection with the upper section 18 and left channel 34.

In FIG. 22, upon applying an downward force upon the right lever 162, the right lever 162 is lowered downward and extended through the upper section 18 of the device 10. As this occurs, a compression spring 164, affixed to the right lever 162 and upper section 18, is compressed between the right lever 164 and the upper section 18 causing a reciprocal pushing force upon the right lever 162 as it is being lowered. Preferably, this reciprocal pushing force is continued to be applied upon the right lever 162. When the lowering of the right lever 162 exits the upper section 18 of the device 10, the right channel 38 will be open through the entire device 10. When the right channel 38 is open and clear, the rope 104 or 108, for example as illustrated in FIGS. 13 through 15, attached to a boat fender or other flotation device 106 or 110, can be inserted into and through the right opening 36 to the right channel 38. In this manner, the rope 104 or 108 are continually inserted and pulled through the right channel 38 in the device 10 until the attached boat fender or other flotation device 106 or 110 are positioned at the desired location 50 along the side of the boat 88. Once this desired location 50 of the boat fender or flotation device 106 or 110 is reached, the right lever 162 is released. As the right lever 162 is released, the compression spring 164, having been compressed and providing an opposing retracting or reciprocal pushing force, is likewise released such that the pushing force of the compression spring 164 forces the right lever 162 upward causing the right lever 162 to enter back into the upper section 18 and back into the right channel 38 causing the opening in the right channel 38 to close. In this manner, upon the closing of the opening, the right lever 162 frictionally secures the rope 104 or 108 within the right channel 38 of the device 10 with the boat fender or other flotation device 106 or 110 remaining positioned at the desired location 50 along the side of the boat 88. The same process is performed to release the rope 104 or 108. Additionally, the mechanics and process works the exact same for the left lever 166 in connection with the upper section 18 and left channel 34.

In FIG. 23, upon applying a pinching or pulling force upon both the left finger 138 and the right finger 140, such that the left finger 138 and the right lever 140 are traversed within their respective curvilinear slots 142 and 144 toward one another, the knub 146 extending outwardly from each of the left finger 138 and right finger 140 is pulled inward within the upper section 18 of the device 10. As this occurs, a left lever 148 connected to the left finger 138 and a right lever 150 connected to the right finger 140 are pulled together causing the compression of a compression spring 152 situated between them. Preferably, this compression force is continued to be applied upon both the left lever 148 and the right lever 150 as each of the left finger 138 and right finger is pulled inward within the upper section 18 of the device 10. When the pinching or pulling force upon both the left finger 138 and the right finger 140 causes the knub 146 extending outwardly from each of the left finger 138 and right finger to exit the upper section 18 of the device 10, the left channel 34 and the right channel 38 will be open through the entire device 10. When the left channel 34 and the right channel 38 are open and clear, the rope 104 or 108, for example as illustrated in FIGS. 13 through 15, attached to a boat fender or other flotation device 106 or 110, can be inserted into and through each of the left opening 32 to the left channel 34 and the right opening 36 to the right channel 38. In this manner, the rope 104 or 108 are continually inserted and pulled through the left channel 34 and/or right channel 38 in the device 10 until the attached boat fender or other flotation device 106 and 110 are positioned at the desired location 50 along the side of the boat 88. Once the desired location 50 of the boat fender or flotation device 106 and 110 is reached, the left finger 138 and the right finder 140 are released. As the left finger 138 and the right finger 140 are released, the compression spring 152, having been compressed and providing an opposing force, is likewise released such that the expanding force of the compression spring 152 forces the left lever 148 and the right lever 150 outward causing both the left finger 138 and the right finger 140 to traverse back through their respective curvilinear slots 142 and 144 away from one another such that the knub 146 extending outwardly from each of the left finger 138 and right finger enters back into left channel 34 and the right channel 38 causing the opening in the left channel 34 and the right channel 38 to close. In this manner, upon the closing of the opening, the knub 146 attached to each the left finger 138 and the right finger 140 to frictionally secure the rope 104 and/or 108 within the applicable left channel 34 and/or right channel 38 of the device 10 with the boat fender or other flotation device 106 or 110 remaining positioned at the desired location 50 along the side of the boat 88. The same process is performed to release the rope 104 and/or 108.

In FIG. 24, upon applying an outward pulling force upon the right lever 154, the right lever 154 is pulled away from the upper section 18 of the device 10. As this occurs, an arm 156 attached to the right lever 154 and situated within the right channel 38 is rotated clockwise. Preferably, the right lever 154 is pulled away from the upper section 18 of the device 10 until it substantially reaches ninety degrees in relation to the upper section 18. When the right lever 154 reaches this position, the rotation of the arm 156 causes it to exit the upper section 18 of the device 10 such that the right channel 38 will be open through the entire device 10. When the right channel 38 is open and clear, the rope 104 or 108, for example as illustrated in FIGS. 13 through 15, attached to a boat fender or other flotation device 106 and 110 (e.g., a first and second boat fender), can be inserted into and through the right opening 36 to the right channel 38. In this manner, the rope 104 or 108 are continually inserted and pulled through the right channel 38 in the device 10 until the attached boat fender or other flotation device 106 and 110 are positioned at the desired location 50 along the side of the boat 88. Once this desired location 50 of the boat fender or flotation device and 110 is reached, the right lever 154 can be returned to its original location. As the right lever 154 is rotated back, the arm 156 attached to the right lever 154 is rotated counter-clockwise to enter back into the upper section 18 and back into the right channel 38 causing the opening in the right channel 38 to close. In this manner, upon the closing of the opening, the arm 156 frictionally secures the rope 104 or 108 within the right channel 38 of the device with the boat fender or other flotation device 106 or 110 remaining positioned at the desired location 50 along the side of the boat 88. The same process is performed to release the rope 104 or 108. Additionally, the mechanics and process works the exact same for the left lever 158 and left arm 160 in connection with the upper section 18 and left channel 34.

Thus, there has been provided Applicant's unique invention and method and apparatus for installing a boat fender or other flotation device on the side of a boat. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the disclosure contained herein and appended claims.

What is claimed is:

1. A device for use with a boat comprising:

a housing defining a front side, a back side, a top side, and a bottom side;

a first hollow channel situated between the front side and the back side:

an opening provided in the top side and extending into a slot situated within the housing, the slot in open communication with the first hollow channel:

a handle connected to an elongated arm, the handle situated within the opening in the top side and the elongated arm situated within the slot;

means for simultaneously moving the handle from a first position in relation to the opening in the top side to a second position in relation to the top side and moving the elongated arm from a first position in relation to the slot to a second position within a hollow passageway comprises applying a downward force upon the handle;

means for simultaneously moving the handle from the second position in relation to the opening in the top side back to the first position in relation to the top side and moving the elongated arm from the second position in relation to the hollow passageway back to the first position within the slot; and means for securing a rope inserted into the first hollow channel.

2. The device of claim 1 wherein the means for simultaneously moving the handle from the second position in relation to the opening in the top side back to the first position in relation to the top side and moving the elongated arm from the second position in relation to the hollow passageway back to the first position within the slot comprises a compression spring engageable between the handle and bottom side of the housing.

3. The device of claim 2 wherein the handle and the elongated arm are situated at substantially a perpendicular angle to one another.

4. The device of claim 3 wherein the means for securing a rope inserted into the first hollow channel comprises frictionally securing the rope between the elongated arm and the first hollow channel from the force of the compression spring.

5. The device of claim 4 and further comprising prongs extending outwardly from the elongated arm, the prongs engageable with the rope to further coact to frictionally secure the rope between the elongated arm and the first hollow channel.

6. The device of claim 5 and further comprising a second hollow channel situated between the front side and the back side.

7. The device of claim 6 and further comprising a base fixedly secured to the housing.

8. The device of claim 7 and further comprising means for releaseably attaching the base to the boat to secure the housing to the boat.

* * * * *